United States Patent [19]

Monahan

[11] Patent Number: 4,712,401

[45] Date of Patent: Dec. 15, 1987

[54] RANDOMLY AND INTEGRALLY RE-KEYABLE LOCK APPARATUS AND METHOD

[76] Inventor: Brian J. Monahan, 28895 Cragmont Dr., Evergreen, Colo. 80439

[21] Appl. No.: 881,227

[22] Filed: Jul. 20, 1986

[51] Int. Cl.[4] ..... E05B 25/00

[52] U.S. Cl. ..... 70/382; 70/384; 70/385

[58] Field of Search ..... 70/382, 383, 384, 385, 70/388, 395, 397, 400

[56] References Cited

U.S. PATENT DOCUMENTS

| | | | |
|---|---|---|---|
| 1,819,853 | 8/1931 | Von Mehren . | |
| 1,896,319 | 2/1933 | Littell | 70/382 |
| 2,113,007 | 4/1938 | Swanson | 70/382 |
| 2,326,358 | 8/1943 | Hull | 70/385 |
| 2,910,860 | 11/1959 | Camba | 70/388 |
| 3,070,987 | 1/1963 | Baker et al. | 70/383 |
| 3,078,705 | 2/1963 | Morrison, Jr. | 70/383 |
| 3,125,878 | 3/1964 | Gutman | 70/383 |
| 3,320,781 | 5/1967 | Hill | 70/384 |
| 3,589,153 | 6/1971 | Hill | 70/384 |
| 3,667,262 | 6/1972 | Hill | 70/384 |
| 4,412,437 | 11/1983 | Smith | 70/385 |
| 4,440,009 | 4/1984 | Smith | 70/385 |

FOREIGN PATENT DOCUMENTS

| | | | |
|---|---|---|---|
| 1125046 | 6/1982 | Canada | 70/383 |
| 0006765 | 1/1983 | European Pat. Off. | 27/4 |

*Primary Examiner*—Robert L. Wolfe
*Attorney, Agent, or Firm*—Chester E. Martine, Jr.

[57] ABSTRACT

A lock apparatus includes a lock provided with a cylindrical plug having a keyway widened to form a slot adjacent the bottom surface of the plug for receiving a master pin from a top pinway of the lock. The slot has shoulders at the opposite ends thereof to prevent removal of the master pin from the lock. If the lock has been assembled, the plug is removed to facilitate forming the slot, removing any ribs that are at the bottom of the keyway and inserting a master pin between the driver pin and the tumbler pin in a first one of the pinways.

A transfer key has bittings for positioning the master pin in the top portion of the first pinway with the bottom of the master pin aligned with the shear interface. A transfer tool is slidable relative to the transfer key on the side thereof opposite to the bittings and has a cut for receiving the master pin from the first pinway. The tool slides relative to the transfer key and moves the master pin in the slot to directly reposition the master pin adjacent a randomly selected second pinway. A handle rotates the tool relative to the transfer key to cam the master pin out of the cut into the second pinway to change the height of the pin stack in the second pinway to randomly and integrally re-key the lock without removal of the master pin from the lock or disassembly of the lock.

27 Claims, 20 Drawing Figures

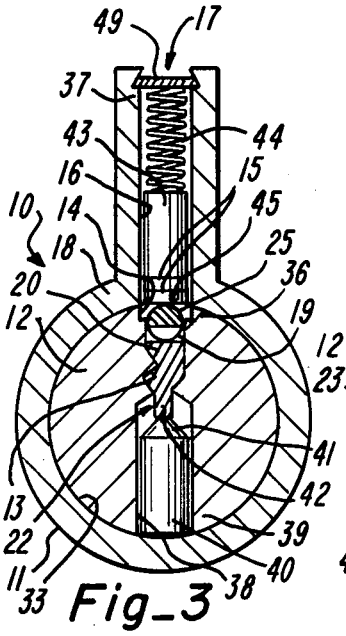
Fig_3
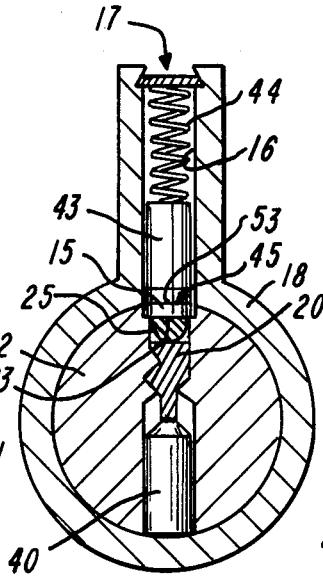
Fig_4
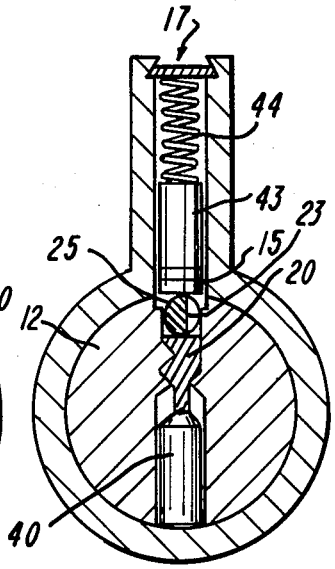
Fig_5
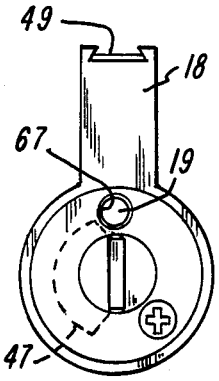
Fig_6
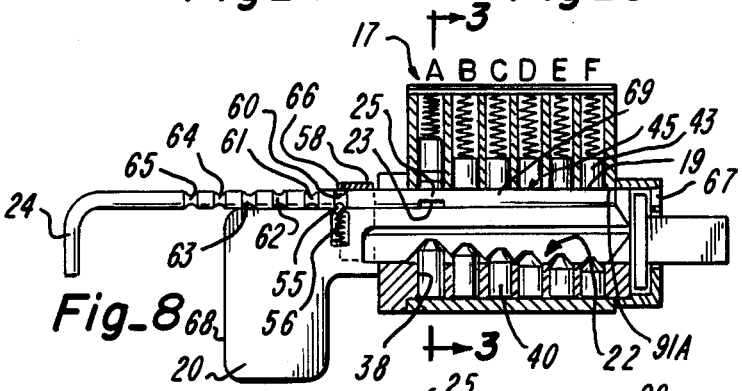
Fig_8
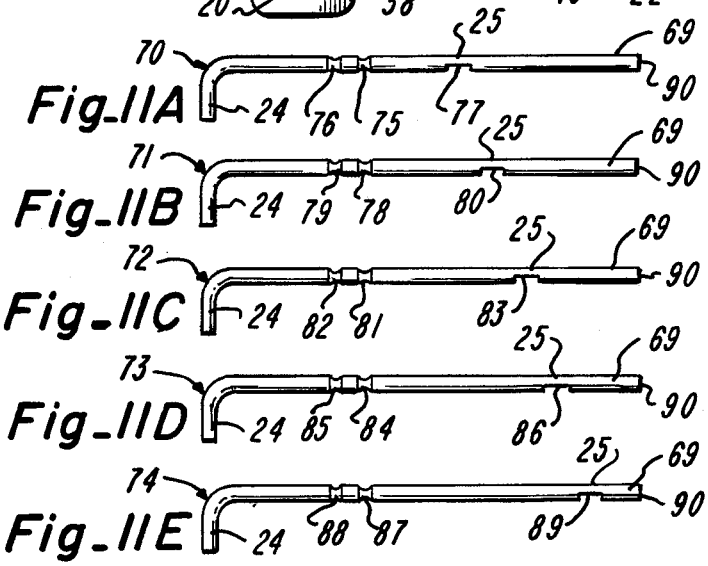
Fig_11A
Fig_11B
Fig_11C
Fig_11D
Fig_11E

RANDOMLY AND INTEGRALLY RE-KEYABLE LOCK APPARATUS AND METHOD

BACKGROUND OF THE INVENTION

1. Field of the Invention

The present invention relates to locks and more particularly to an apparatus for and method of rekeying a pin tumbler cylinder lock having tumbler pins, driver pins and at least one master pin without disassembly of the lock apparatus or removal or replacement of any master pins therefrom or therein.

2. Description of the Prior Art

The pin tumbler lock principle is widely used in builders hardware locks, padlocks and cabinet locks. A pin tumbler lock housing has a cylindrical main bore extending longitudinally therethrough to rotatably accommodate a cylindrical plug having a flange at its front end to limit its rearward movement relative to the housing. The plug has a keyway extending longitudinally therethrough at the bottom of the plug. A plurality of parallel and equally spaced cylindrical top pinways extend perpendicular to the main bore from the top of the housing into the main bore to align with correspondingly spaced cylindrical bottom pinways extending from the top of the plug to part way into the keyway. Retainers of various types secured to the rear end of the plug provide a minimum of end play between the plug and the housing when the lock is assembled. Each pinway extending from the top of the housing to part way into the keyway has within it a tumbler pin having a truncated conical bottom end that engages a truncated cut or bitting on the top edge of a key inserted in the keyway. The bitting positions the tumbler pin vertically in the pinway. Above each tumbler pin is a driver pin of sufficient height to block a shear interface between the plug and the housing when the tumbler and driver pins are bottomed in their pinway. Above each driver pin is a compression spring that biases the driver pin and the tumbler pin in a downward direction. The height of a tumbler pin is such that the interface between the tumbler pin and the driver pin is located at the shear interface by a properly selected bitting on a key inserted in the keyway. When the key bittings locate all such driver pin and tumbler pin interfaces at the shear interface, the plug is free to rotate and retract a bolt or latch by means of the surfaces of the retainer, or an extension thereof, acting on the bolt or latch.

Tumbler pin heights and bitting depths of the key are multiples of an increment established by the manufacturer. There are usually ten tumbler pin heights and ten corresponding bitting depths numbered zero through nine, zero designating the shortest tumbler and the shallowest bitting depth and nine designating the tallest tumbler and the deepest bitting depth. The increment is large enough to ensure that a key having one or more bitting depths shallower or deeper than corresponding tumblers will not permit the plug to rotate because of the normal clearance between the plug and the housing.

A key that is intended for use with an individual lock or a group of locks keyed alike is referred to as a change key. A key that will operate a group of locks, each of which is operated by its own unique change key, is referred to as a master key. Pin tumbler locks are masterkeyed by using short pins called master pins between the tumbler pin and the driver pin in a given pinway. A tumbler pin, a driver pin and any master pins between them can be referred to as a tumbler stack. The interface between a master pin and a driver pin usually determines the change key bitting. The interface between the tumbler pin and the master pin usually determines the master key bitting. A plurality of locks can thus be set up to each operate only with its own unique change key, yet all of the locks can be operated with the same master key.

For ease of reference, the locations of the pinways, and thus the locations of the bittings for operating the tumbler stack in the respective pinways, are referred to as stations designated by the letters A, B, C, etc., with station A relating to the pinway that is closest to the front of the lock.

The necessity to re-key locks is an ongoing problem, particularly with a turnover of employees and tenants. Some concerns, such as banks, consider re-keying on a periodic basis to be a matter of good policy. Normally, re-keying for a different unique change key of a lock requires disassembly of the lock and removal and replacement of tumbler pins with tumbler pins of different heights if the lock is not masterkeyed. If masterkeyed, removal and replacement with different-height master pins has been required. Ideally, the delay in waiting for and the expense of a locksmith are to be avoided.

Attempts have been made to remove a temporary pin from a lock so that the lock cannot be operated by a temporary key. The temporary pin is provided in one of the pinways. When the removable temporary pin is removed from such lock, the original temporary key is no longer usable to operate the lock because the driver pin extends across the shear interface when the temporary key is used. In such lock, a disabling key is bitted such that the driver pin-tumbler pin interfaces of the pins in the pinways that do not have removable pins are aligned with the shear interface. Also, the removable temporary pin is in the top pinway with the bottom thereof aligned with the shear interface. The disabling key is thus enabled to rotate the plug so that a cut in the bottom of the disabling key is positioned under the top pinway. The keyway is enlarged to allow the removable pin to move into the cut and, as the disabling key is removed from the lock, to allow the removable pin to be pulled completely out of the lock. Such locks could provide re-keying by requiring use of many different change keys only to the extent that many removable temporary pins are provided when the lock is originally assembled. Such requirement for many removable pins to enable use of many different change keys is inherently disadvantageous since the more master pins (e.g. the removable pins) there are in the tumbler stacks, the easier the lock is to pick.

Later attempts to overcome such disadvantage used similar removable master pins and disabling keys to remove such master pins from the lock. Once the removable master pin was removed from the lock, a new removable master pin was loaded into a cut formed in a second re-keying key provided with a leaf spring biased by the removable master pin in the cut. With the new removable master pin held in the cut against the bias of the leaf spring, the second re-keying key was inserted into the keyway. The second key was bitted to operate the lock to allow rotation of the key and plug and positioning of the spring biased new master pin opposite to a desired top pinway. The leaf spring urged the new master pin into the top pinway against the action of the compression spring. Although such second key enabled the replacement of a new master pin into the lock, problems arose in attempting to hold the new master pin in the slot against the action of the leaf spring while inserting the second key and the new master pin into the keyway. Moreover, since the bias of the leaf spring must be greater than that of the compression spring to allow the new master pin to be pushed into the top pinway, the second key cannot be used to remove the removable master pin from the original pinway. Thus, two keys are required to successively remove a master pin from the lock and add a new master pin to the lock. Further, the requirement that the leaf spring act against the bias of the compression spring to push the new master pin into the pinway doesn't provide any positive assurance that the new pin has actually entered the pinway.

Improvements in such locks have been directed to assuring that the removable pins fit loosely in the cut in the first re-keying key and to preventing the driver pins from entering the cut by making the diameter of the cut and the removable pins less than that of the driver pin.

Locks have generally been keyed for operation using many keys, including, for example, a key for use only during construction. The removal of the master pin prevents use of the construction key with the lock, while all of the rest of the original keys can operate the lock. However, the re-keying keys and the structure of the lock do not render the lock usable with only one of the many keys instead of the construction key that is locked-out.

Independent of these efforts to provide a re-keyable lock, in one prior lock a slot was provided in the plug for receiving a slide having eight holes for use with four pinways. When the lock was assembled, the extra or auxiliary holes were either empty, filled with master pins having a height that was equal to the full thickness of the slide or filled with master pins that were shorter than the full thickness of the slide. A set screw was used to move the slide in the slot into one of two positions to align two different sets of the holes with the pinways. Because of the different arrangement of holes and master pins in each of the two positions of the slide, a different change key was required to operate the lock for each position of the slide. However, without increasing the length of the lock, or disassembling the lock, the lock could be re-keyed for only two change keys. Further, because of the variable thickness master pins and empty holes, once the slide was moved to the rear of the lock, the lock had to be disassembled to move the slide forward to re-key the lock.

SUMMARY OF THE INVENTION

In contrast to the prior art that requires two re-keying keys to remove and then replace master pins, or that add a slide to the plug for rearranging holes or different depth master pins, preferred embodiments of the method and apparatus of the present invention minimize the number of master pins used while increasing the number of different change keys to achieve the following objectives.

Initially, the present invention utilizes a change principle wherein master pins can be transferred directly from one pinway to any other pinway in the lock to provide different, exclusive change key bitting combinations or settings.

Secondly, only one exclusive change key bitting at a time can operate the lock and there are a minimum of master pins for an increased number of change keys and maximum pick resistance, yet there is always a master key.

Thirdly, to adapt a standard, existing lock to use the principles of the present invention, the only changes that need be made to the lock are that the bottom of the keyway in the plug is milled wider opposite to and only between the pinways to accommodate the full diameter of the master pins and the full length of the keyway is enlarged end to end to receive a tool for transferring the master pins among the pinways.

Fourthly, the method of the present invention provides a transfer key and a transfer tool that is slidable relative to the bottom edge of the transfer key. With the transfer key and the transfer tool inserted in the keyway, the transfer key guides the transfer tool for longitudinal movement. When the plug is rotated 180° from the locking position and the transfer tool is rotated, a cut provided in the transfer tool captures a master pin from a first pinway. The transfer tool is slid along the transfer key to directly align the cut and the master pin with a selected new pinway. The transfer tool is again rotated so that the master pin rides up onto a cam provided on the tool adjacent to the cut. If the cut is inadvertently aligned with a driver pin instead of a master pin, and the transfer tool is rotated, the driver pin will also be cammed or positively inserted back into the top pinway.

With these and other objects in mind, a pin tumbler lock apparatus in accordance with the present invention is provided with a cylindrical plug having a keyway that is widened to form a slot adjacent the surface of the plug for receiving a master pin from a top pinway of the lock. The slot has shoulders at the opposite ends thereof to prevent removal of the master pin from the lock. If the lock has been assembled, the plug is removed to facilitate forming the slot and inserting a master pin between the driver pin and the tumbler pin in a first one of the pinways.

The apparatus includes a transfer key for facilitating re-keying of the lock. The transfer key has bittings along a first edge thereof for positioning the master pin in the top portion of the first pinway and aligning the bottom of the master pin with the shear interface. A transfer tool slidable relative to the transfer key on the side thereof opposite to the bittings is provided with a cut or slot for receiving the master pin from the first pinway. The tool slides relative to the transfer key parallel to the keyway for directly repositioning the master pin adjacent a randomly selected second pinway without removal of the master pin from the lock. The apparatus includes a handle for rotating the tool relative to the transfer key to cam the master pin out of the cut in the tool and into the second pinway to change the height of the second pin stack in the second pinway without removal of the master pin from the lock.

In a preferred embodiment of the present invention, the tool is a cylindrical rod. The cut is in one side thereof and extends perpendicular to the longitudinal axis of the rod. The rod has a cam surface adjacent the cut. When the master pin is received in the cut, the handle is effective to rotate the rod so that the master pin rides onto the cam surface and moves into the second pinway so that the bottom of the master pin is aligned with the shear interface. The rod and the transfer key are provided with cooperating releasable detents for sequentially aligning the cut with the first and second pinways to position the slot for successively receiving the master pin from the first pinway and then moving the master pin into the second pinway.

A method in accordance with the present invention may render a pin tumbler lock usable with a plurality of different change keys without disassembling the lock or removing any parts from or replacing any parts in the lock each time the lock is reset for a different change key. The method may be performed with a standard pin tumbler lock or a lock of the present invention. The method for the standard lock includes the steps of removing the plug from the bore and enlarging the keyway along the intersection thereof with the bottom of the plug and only for a distance corresponding to the distance from the first pinway to the second pinway. The depth and width of the enlarged keyway are sufficient to receive a master pin that is inserted into a first pinway. Also, if the bottom of the keyway has ribs, the full length of the keyway is also milled to provide room for a master pin transfer tool. The plug is replaced in the bore to render the lock usable with a plurality of different change keys.

To re-key the lock, a transfer key is provided and has bittings along one edge for unlocking the lock. The master pin transfer tool is slidable along an opposite edge of the transfer key. The lock is unlocked by inserting the transfer key and the transfer tool into the keyway and rotating the plug with the transfer key and the transfer tool to position the transfer tool adjacent the top pinways. The transfer tool is moved along the transfer key to position the cut for receiving the master pin from the first pinway. The transfer tool is rotated to capture or receive the master pin. The transfer tool then slides the master pin within the enlarged keyway directly into alignment with the second pinway without removal from the lock. The tool is rotated relative to the transfer key to cause the master pin to ride onto the cam surface formed on the tool adjacent the cut to positively insert the master pin into the second pinway. The master pin changes the height of the pin stacks in the first and second pinways so that the second change key may, and should, have a deeper bitting depth at the second station and must have a shallower bitting depth at the first station.

The method of rendering a lock re-keyable also includes steps by which the setting of the lock may be reversed without disassembling the lock, including unlocking the lock by again inserting the transfer key and the transfer tool into the keyway and rotating the plug, the transfer key and the transfer tool to position the transfer tool opposite the top pinways. The moving steps are again performed with the slot initially positioned to receive the master pin from the second pinway and to transfer the master pin to and insert it into the first pinway. The rotating step is performed again to restore the stack heights to their original amounts without disassembling the lock. Alternatively, if the lock is provided with pinways intermediate the first and second pinways, the unlocking, moving and rotating steps can be performed to insert the master pin directly into a selected one of the intermediate pinways without removing the master pin from the lock or disassembling the lock.

BRIEF DESCRIPTION OF THE DRAWINGS

As will appear from the description to follow, the present invention can be constructed in other forms and configurations. The foregoing and other features and advantages of the invention will become apparent upon making reference to the drawings wherein:

FIG. 3 is a partial vertical cross section through the center of the forwardmost pinway with a tumbler pin, two master pins, a driver pin and a spring shown full bodied;

FIG. 4 is similar to FIG. 3 but shows the transfer tool rotated 180° and one master pin in a cut in the transfer tool;

FIG. 5 is similar to FIG. 4 but shows the transfer tool rotated 90° and the master pin cammed back up into a housing pinway;

FIG. 6 is a rear view of the lock with the plug rotated 180° from the locking position and showing a hole in the retainer for allowing the transfer tool to extend rearwardly of the retainer;

FIG. 8 is a cross sectional view similar to FIG. 7, but the first change key has been removed from the lock and the transfer key and the transfer tool, shown full bodied, have been inserted into the lock;

FIGS. 11A through 11E are right side views of a second embodiment of the present invention showing five transfer tools, the topmost of which permits transferring a master pin from the A pinway to the B pinway and back again to the A pinway, and the others of which permit transposing master pins between adjacent pairs of pinways among the rest of the pinways without any of the five transposing tools extending rearwardly of a retainer that is not provided with the hole shown in FIG. 6;

DESCRIPTION OF THE PREFERRED EMBODIMENTS

Figure 1:
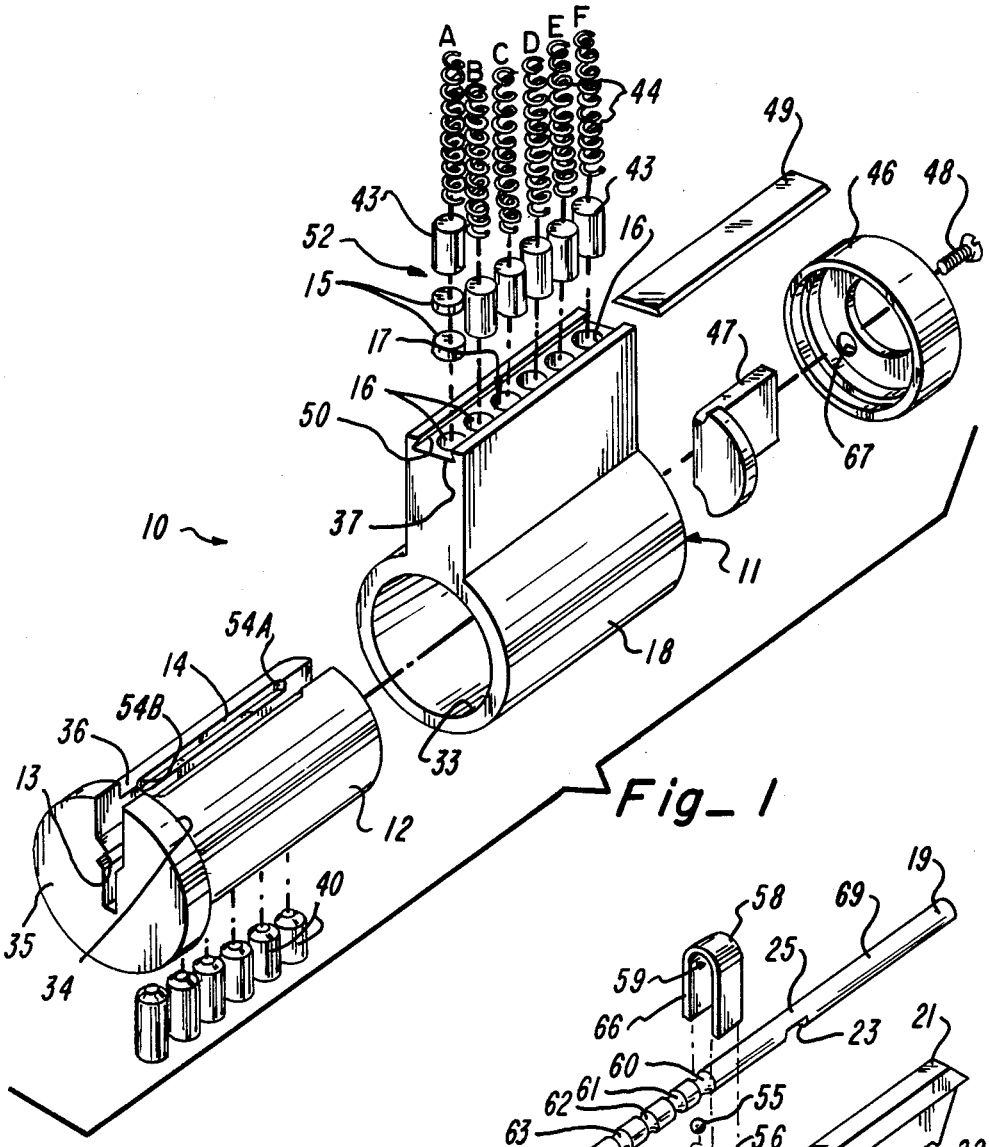
FIG. 1 is an exploded view of the lock with the plug rotated 180° from a locking position.

The first preferred embodiment of the lock apparatus of the present invention is illustrated in FIG. 1 as including a lock apparatus 10 that may be used to perform the methods of the present invention to render a pin tumbler lock 11 re-keyable and to re-key the lock 11 without disassembling the lock 11 or removing any parts from or replacing any parts in the lock 11. A cylindrical plug 12 of the lock 11 has a keyway 13 that is widened to form a slot 14 having a width and depth sufficient for receiving a master pin 15 from a top portion 16 of one of a series of pinways 17. The slot 14 has a limited length in the direction of the keyway 13 to prevent removal of the master pin 15 from the lock 11.

In the method of rendering the lock 11 re-keyable, if the lock 11 has been assembled, the plug 12 is removed from a housing 18 to facilitate forming the slot 14 in the plug 12, whereafter the plug is replaced in the housing 18.

A transfer tool 19 (FIG. 2) is slidably mounted on a transfer key 20 on a side 21 of the key 20 opposite to bittings 22. A cut or slot 23 formed in the transfer tool 19 receives the master pin 15 from a first one of the pinways 17 (station A, for example, FIG. 8). The transfer tool 19 is slidable relative to the transfer key 20 for repositioning the master pin 15 randomly and directly from the first of the pinways 17 to any second one of the pinways 17 (station B, for example) without removing the master pin 15 from the lock 11. The tool 19 is provided with a handle 24 for rotating the tool 19 relative to the transfer key 20 so that the master pin 15 rides out of the slot 23 onto a cam surface 25 (FIGS. 2 through 5) that lifts the master pin 15 and positively inserts it into the second one of the pinways 17.

Figure 7:
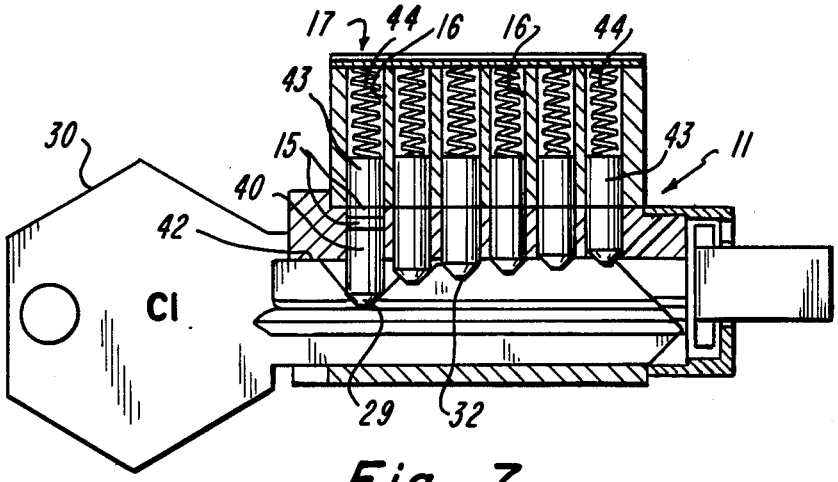
FIG. 7 is a partial vertical transverse cross sectional view through the center of the assembled lock showing the master pins in a randomly selected, initial pinway and a first change key shown having bittings for operating the lock.

With the master pin 15 transferred from the first one of the pinways 17 into the second one of the pinways 17, a bitting 26 for station A (corresponding to the first one of the pinways 17) of a secnd change key 27 (FIG. 9) must be shallower than the station A bitting 29 of an original or first change key 30 (FIG. 7). Also, a station C bitting 31 (for the second one of the pinways 17) of the second change key 27 may, and should, be deeper than a station C bitting 32 of the original change key 30 to operate the lock 11.

The method of re-keying the lock 11 according to the present invention includes using the transfer key 20 to unlock the lock 11. With the transfer tool 19 positioned along the transfer key 20, the transfer key 20 is rotated to position the cut 23 of the transfer tool 19 adjacent the first one of the pinways 17 (station A, FIG. 8) that contains the master pin 15. The handle 24 is rotated to move the cut 23 into position for receiving the master pin 15. The transfer tool 19 is then slid along the transfer key 20 to align the master pin 15 with the second of the pinways 17 (station C, FIG. 7). The second pinway 17 can be any one of the other pinways 17. The handle 24 is again rotated so that the master pin 15 rides up onto the cam surface 25 and is positively inserted into the second one of the pinways 17 (FIG. 5). The transfer key 20 and the transfer tool 19 are then rotated with the plug 12 to their original position, and the transfer key 20 and the transfer tool 19 are removed from the keyway 13 leaving the lock 11 ready to accept the second change key 27 that has the bittings 26 and 31 and other bittings 22 adapted to operate the lock 11.

Referring now to FIGS. 1 and 3, the housing 18 is shown in conventional construction including a cylindrical main bore 33 extending longitudinally therethrough to rotatably accommodate the cylindrical plug 12 having a flange 34 at its front end 35 to limit its rearward movement relative to the housing 18. The plug 12 has the keyway 13 extending longitudinally therethrough at the bottom 36 of the plug 12, it being understood that FIG. 1 shows the plug 12 rotated 180° to show the slot 14. A plurality of the top portions 16 of the pinways 17 are shown in cylindrical form, parallel and equally spaced extending perpendicular to the main bore 33. The top portions 16 extend from the top 37 of the housing 18 into the main bore 33. The top portions 16 are aligned with correspondingly spaced, parallel cylindrical bottom portions 38 of the pinways 17 extending from a top 39 of the plug 12 to part way into the keyway 13.

Each pinway 17 has within it a tumbler pin 40 having a truncated conical bottom end 41 that engages the bittings 22, which may be in the form of truncated cuts on the top edge 42 of the transfer key 20 or on the change keys 27 and 30 that may be inserted into the keyway 13. The bittings 22 position the tumbler pins 40 vertically in the pinway 17. Above each tumbler pin 40 is a driver pin 43 of sufficient height to block a shear interface 45 between the plug 12 and the housing 18 when the tumbler pin 40 and the driver pin 43 are bottomed in their pinway 17. Above each driver pin 43 is a compression spring 44 that biases the driver pin 43 and the tumbler pin 40 in a downward direction. The height of the tumbler pin 40 is such that the interface between the tumbler pin 40 and the driver pin 43 is located at the shear interface 45 by a properly selected bitting 22 on any of the keys 20, 27 or 30 inserted in the keyway 13. When the key bittings 22 locate all such driver pin-tumbler pin interfaces at the shear interface 45, the plug 12 is free to rotate and retract a bolt or latch (not shown) by means of the surfaces of a retainer 46, or an extension thereof, or a tailpiece 47, acting on the bolt or latch.

The lock 11 is assembled by inserting the plug 12 into the main bore 33 of the housing 18 and slipping the retainer 46 over the rear end of the tailpiece 47. The retainer 46 is secured to the plug 12 such as with a screw 48. With the plug 12 rotated into its original locked position (180° from that shown in FIG. 1), each of the top portions 16 and the bottom portions 38 forms one of the continuous pinways 17. A selected pinway 17, at the A station in FIG. 7, for example, is provided with one tumbler pin 40, two master pins 15, one driver pin 43 and one spring 44. The other pinways 17, for example at stations B through F, are provided with the same tumbler stack without the master pins 15 since a lock having a minimum of master pins 15 is more difficult to pick. Then, by compressing the springs 44 one at a time, a pinway cap 49 is slid into an undercut recess 50 in the housing 18. The final step is to stake the pinway cap 49 in place.

Figure 10:
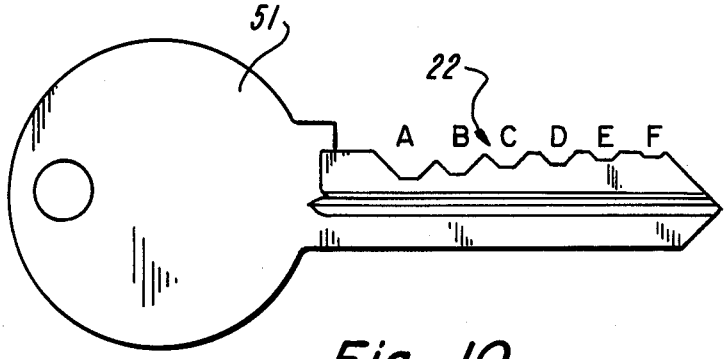
FIG. 10 is a side view of a master key shown having bittings for operating the lock when it is keyed for operation by many unique change keys.

The change keys 27 and 30 are intended for use with an individual lock, such as the lock 11, or with a group of locks that are keyed alike. A master key 51 (FIG. 10) will operate a group of locks, such as the lock 11, each of which is operated by its own unique change key, such as the change key 27.

Pin tumbler locks such as the lock 11 are master-keyed, or rendered usable with master keys 51 by using short pins such as the master pin 15 between the tumbler pin 40 and the driver pin 43 in a given pinway 17 to form a tumbler stack 52 (FIG. 1). The master pin-driver pin interface determines the bitting requirements for the bittings 22 of the change keys 27 and 30, and the interface between the tumbler pin 40 and the master pin 15 determines the bitting requirements for the master key 51. As will become apparent, the present invention provides the ability to re-key locks, such as the lock 11, that are provided with one or more master pins 15. A plurality of the locks 11 can thus be set up to each operate with its own change key, such as the change keys 27 or 30, and all of such locks will operate with the master key 51, and will be re-keyable using the transfer key 20 and the transfer tool 19.

Still referring to FIG. 1, according to the principles of the present invention the conventional lock 11 is modified by forming the slot 14 in the keyway 13 adjacent the bottom 36 of the plug 12. As shown in FIG. 4, the slot 14 is wide enough to receive the master pin 15. The slot 14 is also shown deep enough so that the top 53 (FIG. 4) of one master pin 15 that is received in the slot 14 is in the shear interface 45 so that such master pin 15 can move in the slot 14 directly from a pinway 17 at station A, for example, to a pinway 17 at another station, such as F. The slot 14 has a shoulder 54A (FIG. 1) adjacent station F to prevent movement of a master pin 15 out of the rear of the slot 14. When the master pin 15 is adjacent the shoulder 54A it is aligned with station F. A shoulder 54B prevents movement of the master pin 15 out of the front of the slot 14. When the master pin 15 is proximate the opposite shoulder 54B it is aligned with the pinway 17 at station A.

Also, the bottom of the keyway 13 may be provided with a rib or other projection that normally extends into a groove in the bit of a change key 27, for example. If so, a ball end mill is used at the bottom of the keyway to remove the rib from the entire length of the keyway 13. The transfer tool 19 can then move in the keyway as necessary to transfer the master pin 15 from station to station.

Figure 2:
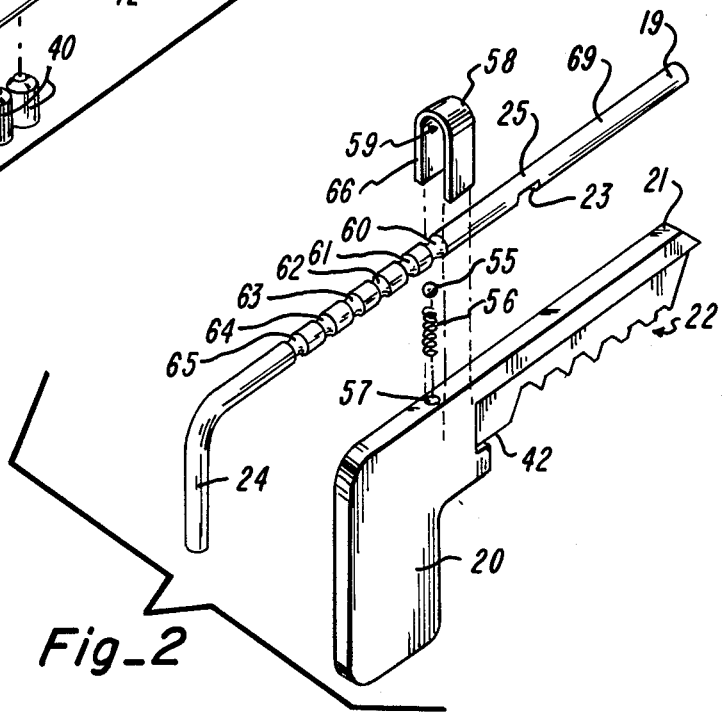
FIG. 2 is an exploded view of a transfer key and a transfer tool shown inverted corresponding to the position of the plug in FIG. 1.

FIG. 2 shows a first preferred embodiment of the transfer key 20 and the transfer tool 19 in an inverted position corresponding to the inverted position of the plug 12 shown in FIGS. 1 and 3 through 5. A ball detent 55 is installed by dropping a spring 56 into a drilled hole 57 in the bottom edge 21 of the transfer key 20. The spring 56 is depressed by pushing the ball detent 55 against it until about one-third of the ball detent 55 projects from the bottom edge 21 of the key 20. The ball detent 55 is then secured by staking the bottom edge 21 of the key partially around the ball detent 55. A saddle-shaped stamping 58 is secured to the key 20 by soldering or spot welding it in place leaving a channel or guideway 59 for insertion of the transfer tool 19.

The transfer tool 19 has six circumferential, radiused groves 60 through 65 that, in conjunction with a front edge 66 of the saddle-shaped stamping 58, act as an index or indicator to show when the cut 23 is opposite to the respective tumbler stations A through F of the lock 11. The radiused grooves 60 through 65 also cooperate with the ball detent 55 to hold the transfer tool 19 in a selected, fixed position longitudinally relative to the transfer key 20. Thus, when the ball detent 55 engages one of the grooves 60 through 65, the transfer tool 19 is releasably held so that the cut 23 is aligned with a selected one of the pinways 17 at the tumbler stations A through F. Because the grooves 60 through 65 extend completely around the circumference of the transfer tool 19, the transfer tool 19 may be rotated while held in any of the positions with the cut 23 aligned with a pinway 17.

Referring to FIG. 6, a hole 67 in the retainer 46 is shown for allowing the transfer tool 19 to extend rearwardly of the retainer 46 so that the cut 23 may be aligned with the various pinways 17 at the stations C through F.

Referring to FIG. 7, the lock 11 is shown keyed for use of the first change key 30. This key 30 is identified as "C1" for reference to Table 1 discussed below. The first change key 27 has bittings of 943210 and the tumbler pins 40 have heights of 543210. Thus, the first change key 27 positions the two master pins 15 in the A station pinway 17 below the shear interface 45. The lock 11 can be re-keyed for use of a randomly selected second change key, such as the change key 27, without disassembly of the lock 11 or removal or replacement of any master pins 15 therefrom or therein. The second change key 30 is identified as "C12" also for reference to Table 1.

Referring now to FIG. 8, the lock 11 is shown assembled with the transfer tool 19 extending through the guideway 59 with the transfer tool 19 and the transfer key 20 inserted into the keyway 13 of the lock 11. When the transfer key 20 is initially inserted into the keyway 13, the handle 24 connected to the tool 19 is located outside of the lock 11 adjacent and in a position extending along an outer end 68 of the transfer key 20. After the transfer key 20, the transfer tool 19 and the plug 12 have been rotated as a unit into the position shown in FIG. 8, the cam surface 25 adjacent the cut 23 is facing upwardly and is adjacent the pinway 17, at the station A. The cam surface 25 retains the lower master pin 15 in the pinway 17 at station A. Further, a laterally extending support surface 69 extends under each of the pinways 17 at the stations B through F to retain the respective driver pin 43 and/or master pin 15 in the respective pinways 17.

The handle 24 is then used to move the tool 19 longitudinally along the transfer key 20 within the channel 59 to position the cut 23 under but rotated 180° from a selected pinway 17, shown in FIG. 8 as that at the station A. The support surface 69 supports the master pins 15. The transfer tool 19 is then rotated 180° as shown in FIG. 4, so that the bottom-most master pin 15 is biased into the cut 23 by the spring 44. The "up" position of the handle 24 (opposite to that shown in FIG. 8) indicates that the cut 23 is in position to receive the bottom-most master pin 15. If the transfer tool 19 is then rotated at least 90° in either direction from that shown in FIG. 4 to that shown in FIG. 5, the master pin 15 rides up onto the cam surface 25 out of the cut 23 and is thus forced or cammed back into the pinway 17 at the station A.

Figure 9:
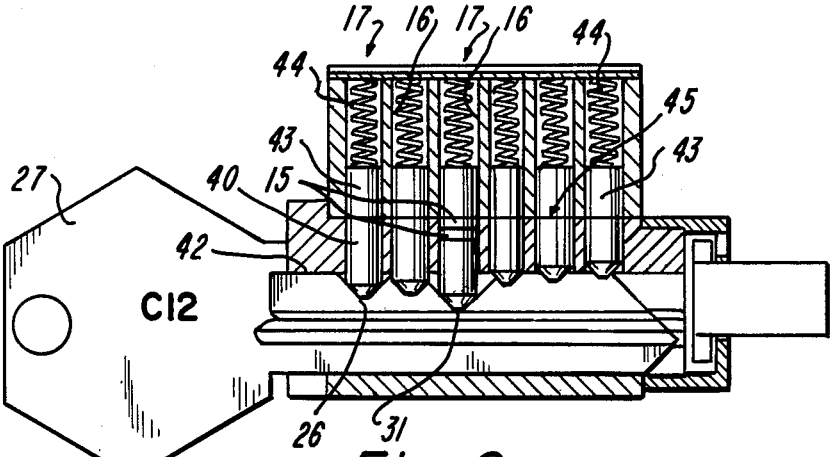
FIG. 9 is a cross sectional view similar to FIG. 8, but the transfer tool and transfer key have been removed from the lock after transfer of the master pins to a randomly selected pinway, and a second change key is shown inserted in the lock and having bittings for operating the lock.

In re-keying the lock 11, the master pin 15 is in the cut 23 as shown in FIG. 4 and the transfer tool 19 is then moved longitudinally along the transfer key 20 to place the cut 23 and the master pin 15 therein opposite to a pinway 17 at a different one of the tumbler stations B through F. In the example given of re-keying the lock 11 for use of the second change key 27, the master pin 15 is transferred to the C station pinway 17. When the cut 23 is between the pinways 17, the transfer tool 19 will rotate no more than a few degrees, which indicates with certainty that the master pin 15 is captured in the cut 23 and may be moved into alignment with a selected pinway 17 at one of the stations A through F. The handle 24 is then used to rotate the transfer tool 19 90° to cam the master pin 15 into that station C pinway 17. As shown in FIG. 5, the cam surface 25 positively holds the bottom-most master pin 15 in the pinway 17 with which the cut 23 is aligned. It may be understood that the position of the handle 24 (90° on either side of that shown in FIG. 8) indicates that the master pins 15 are retained in the various pinways 17 by either the cam surface 25 or the support surface 69 of the transfer tool 19. With the bottom-most master pin 15 transferred out of the station A pinway 17 and transferred directly into the station C pinway 17, the transfer tool 19 is kept in position with the handle 24 down. The transfer tool 19 is then slid outwardly in the guideway 59 to again position the cut 23 opposite to the station A pinway 17. The tool 19 is rotated 180° until the handle is up and the above steps are repeated to transfer the second master pin 15 into the station C pinway 17. The transfer tool 19 and the transfer key 20 are then removed from the keyway 13 and the second change key 27 is inserted (FIG. 9). The resulting re-keying of the lock 11 changes the heights of the tumbler stacks 52 so that the second change key 27 may have a deeper bitting depth at the bitting 31 at the station C and must have a shallower bitting depth at the bitting 26 at the station A from which the master pins 15 were transferred. Further, to be consistent with the bitting arrangement of the change keys 27 and 30, the station C bitting should be deeper so that the change key 27 will position the master pin 15 below the shear interface 45. In particular, referring to FIG. 9, the lock 11 is shown re-keyed and the second change key 27 inserted into the keyway 13. The second change key has bittings 22 of 547210, which positions the master pins 15 in station C below the shear interface 45 to allow the lock 11 to operate. It may be observed that the station A bitting 26 is cut to five depths, which is shallower than the nine depths at the A station 29 to which the first change key 30 is cut. If the C station of the second change key 27 were cut deeper than seven depths the lock 11 would not operate since the driver pin 43 would be across the shear interface 45.

While the preferred embodiment of the lock 11 is provided with the hole 67 for use of a relatively long transfer tool 19, a second preferred embodiment of the lock apparatus 10 of the present invention is shown in FIGS. 11A through 11E. There, five tools 70 through 74 are shown, the topmost one 70 of which permits transferring a master pin 15 from the forwardmost pinway 17 at the station A to the second pinway 17 at the station B and back again. The other transfer tools 71 through 74 permit the transfer of the master pins 15 between any two other adjacent pinways 17 without any of the transfer tools 71 through 74 extending rearwardly of the inside front of the retainer 46. The hole 67 in the retainer 46 is thus unnecessary and the lock 11 may be re-keyed while it is in the installed position.

Referring in greater detail to FIGS. 11A through 11E, the transfer tools 70 through 74 are shown. Considering the transfer tool 70, when indicator grooves 75 and 76 are aligned with the front edge 66 of the saddle 58, a cut 77 formed in the tool 70 is aligned respectively with the A station pinway 17 and the B station pinway 17. Similarly, the transfer tool 71 is provided with indicator grooves 78 and 79. When these indicator grooves 78 and 79 are aligned with the front edge 66 of the saddle 58 a cut 80 formed in the transfer tool 71 is aligned respectively with the stations B and C pinways 17. The same applies to the transfer tool 72 having indicator grooves 81 and 82 and a cut 83 therein. Thus, when the grooves 81 and 82 are successively aligned with the front edge 66 of the saddle 58, the cut 83 is successively aligned with the C and D station pinways 17 respectively. Similarly, the transfer tool 73 is provided with indicator grooves 84 and 85 for indicating alignment of a cut 86 with respective D and E station pinways 17. Finally, the transfer tool 74 is provided with indicator grooves 87 and 88 and a cut 89. Successive alignment of the grooves 87 and 88 with the front edge 66 of the saddle 58 successively aligns the cut 89 with the E and F station pinways 17. Each of the transfer tools is provided with the cam surface 25 and the support surface 69 as described above with respect to the transfer tool 19.

Still referring to FIGS. 11A through 11E and referring to FIG. 8, it may be understood that a leading end 90 of each of the transfer tools 70 through 74 will be positioned at a rearward end 91A of the housing 11 when the cut 77, 80, 83, 86 and 89 is aligned with the respective A, B, C, D and E station pinways 17. The support surfaces 69 of the transfer tools 70 through 74 thus extend under all of the driver pins 43 to support them and allow movement of the transfer tools 70 through 74 to the next adjacent and rearward pinway 17. The support surface 69 is similarly effective to support the driver pins 43 when each of the transfer tools 70 through 74 is positioned in its rearwardmost position. This allows each of the transfer tools 70 through 74 to move forwardly to the next forwardmost pinway 17.

The support surfaces 69 hold the driver pins out of the slot 14 during transfer of a master pin 15 into the respective ones of the cuts 77, 80, 83, 86 or 89 in the transfer tools 70 through 74. Thus, the transfer tools 70 through 74 may be slid along the transfer key 20 rearwardly to transfer the master pin 15 into alignment with the next adjacent pinway 17 without having the driver pin 43 of the adjacent pinway 17 interfere with the leading end 90 of the transfer tools.

Figure 13:
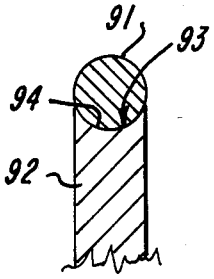
FIG. 13 is a vertical cross sectional view of the transfer tool shown in FIG. 12 illustrating a guideway formed in the transfer key.
Figure 12:
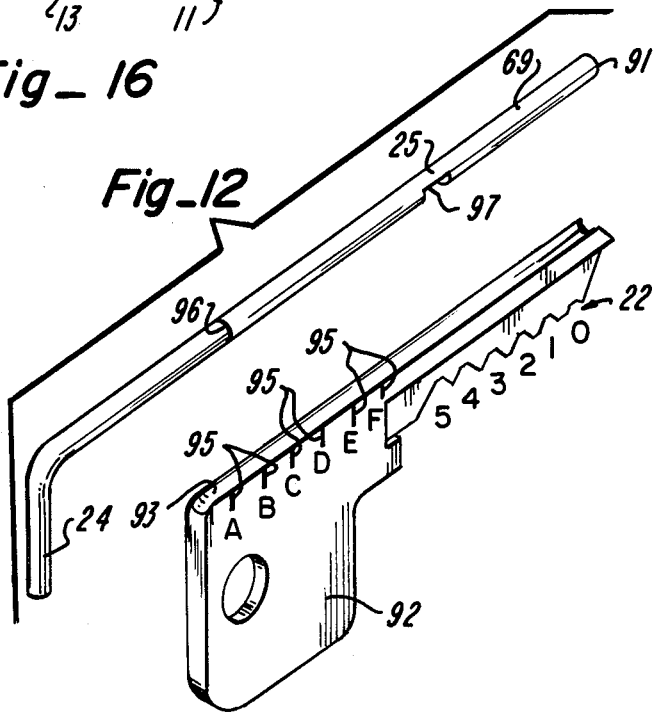
FIG. 12 is an exploded view of a third embodiment of the transfer key and the transfer tool of the present invention.

Referring now to FIGS. 12 and 13, a third embodiment of the present invention includes a transfer tool 91 and a transfer key 92. The transfer key 92 is provided with master key bittings 22 of 543210. The transfer key 92 is provided with a guideway 93 formed by an arcuate surface 94 (FIG. 13) that corresponds to the shape of the outer surface of the transfer tool 91. Indicator lines 95 on the transfer key 92 cooperate with a line 96 provided on the transfer tool 91 to indicate when a cut 97 provided in the tool 91 is aligned with the respective A through F station pinways 17. The cam surface 25, the support surface 69 and the handle 24 are also provided on the transfer tool 91. The operation of the transfer tool 91 and the transfer key 92 are the same as described above with respect to the transfer tool 19 and the transfer key 20, with the lines 95 and 96 corresponding to the grooves 60 through 65 and the edge 66.

TABLE 1

| Master Pin Positions | | | | | | Change Key | Change Key Bittings | | | | | |
|---|---|---|---|---|---|---|---|---|---|---|---|---|
| A | B | C | D | E | F | I.D. | A | B | C | D | E | F |
| 2 | | | | | | C1 | 9 | 4 | 3 | 2 | 1 | 0 |
| 2 | | | | | | | | | | | | |
| 2 | 2 | | | | | C2 | 7 | 6 | 3 | 2 | 1 | 0 |
| 2 | | 2 | | | | C3 | 7 | 4 | 5 | 2 | 1 | 0 |
| 2 | | | 2 | | | C4 | 7 | 4 | 3 | 4 | 1 | 0 |
| 2 | | | | 2 | | C5 | 7 | 4 | 3 | 2 | 3 | 0 |
| 2 | | | | | 2 | C6 | 7 | 4 | 3 | 2 | 1 | 2 |
| | 2 | | | | 2 | C7 | 5 | 6 | 3 | 2 | 1 | 2 |
| | 2 | | | 2 | | C8 | 5 | 6 | 3 | 2 | 3 | 0 |
| | 2 | | 2 | | | C9 | 5 | 6 | 3 | 4 | 1 | 0 |

TABLE 1-continued

| Master Pin Positions | | | | | | Change Key | Change Key Bittings | | | | | |
|---|---|---|---|---|---|---|---|---|---|---|---|---|
| A | B | C | D | E | F | I.D. | A | B | C | D | E | F |
| | 2 | 2 | | | | C10 | 5 | 6 | 5 | 2 | 1 | 0 |
| | 2 | | | | | C11 | 5 | 8 | 3 | 2 | 1 | 0 |
| | 2 | | | | | | | | | | | |
| | | 2 | | | | C12 | 5 | 4 | 7 | 2 | 1 | 0 |
| | | 2 | | | | | | | | | | |
| | | 2 | 2 | | | C13 | 5 | 4 | 5 | 4 | 1 | 0 |
| | | 2 | | 2 | | C14 | 5 | 4 | 5 | 2 | 3 | 0 |
| | | 2 | | | 2 | C15 | 5 | 4 | 5 | 2 | 1 | 2 |
| | | | 2 | | 2 | C16 | 5 | 4 | 3 | 4 | 1 | 2 |
| | | | 2 | 2 | | C17 | 5 | 4 | 3 | 4 | 3 | 0 |
| | | | 2 | | | C18 | 5 | 4 | 3 | 6 | 1 | 0 |
| | | | 2 | | | | | | | | | |
| | | | | 2 | | C19 | 5 | 4 | 3 | 2 | 5 | 0 |
| | | | | 2 | | | | | | | | |
| | | | | 2 | 2 | C20 | 5 | 4 | 3 | 2 | 3 | 2 |
| | | | | | 2 | C21 | 5 | 4 | 3 | 2 | 1 | 4 |
| | | | | | 2 | | | | | | | |

Referring now to Table 1, the advantages of the lock apparatus 10 and the methods of the present invention may be appreciated in terms of the many different change keys 27 and 30 that can be randomly used without disassembling the lock 11 or removing or replacing any master pins 15 therefrom or therein. Table 1 lists the exclusive master pin positions of a lock 11 provided with two, two-depth master pins 15 and change key bittings 22 based upon a master key 51 having bittings of 543210 and the tumble pins 40 having heights of 543210. The use of the master pins 15 having a minimum of two-depths is preferred because the use of one-depth master pins 15 could result in the unintentional operation of a lock 11 with a change key 30 having one or more bittings 22 one depth deeper than the bittings 22 for which the lock 11 is set, a technique known as key picking, or pulling the key 30 outward to lift the tumbler pins 40, the master pins 15 and the driver pins 43, and jiggling the key 30 to separate the pins and obtain rotatable release of the plug 12. The six pinways 17 corresponding to the tumbler stations A through F (starting at the forwardmost pinway 17) correspond respectively in Table 1 to the letters A through F under the heading "Master Pin Positions". The six stations of the change keys 27 and 30 are correspondingly lettered A through F in Table 1 under the heading "Change Key Bittings". The shallowest bitting 22 is zero and the deepest bitting 22 is nine. Adding the depths of both master pins 15 in their various stations A through F to the depths of the bittings 22 of the master key 51 provides the bitting depths of the change keys 27 and 30. Listed in Table 1, along with master pin positions and change key bittings, are numbered change key designations for the change keys, such as the change keys 27 and 30. More particularly, to determine the bittings 22 for the "C1" change key 27, the master pin bittings of 543210 are increased by the depths of each master pin, which is two. Since two of the master pins 15 are at station A, the station A bitting 22 of the master key 51 is 5 plus the four depths of the two master pins 15 result in an A station bitting 22 of a depth 9 of the "C1" change key 27. As shown in Table 1, with only six pinways 17 and two master pins 15, the lock 11 of the present invention may be used with one master key 51 and 21 change keys, such as the change keys 27 and 30, each of which change keys has a unique combination of bittings 22. Once the slot 14 and hole 67 (if desired) are provided, the method described above may be used in conjunction with the Master Pin Positions shown in Table 1 to re-key the lock 11 without disassembly or removal or replacement of any of the master pins 15 therefrom or therein to render the lock 11 operable by a selected one of the change keys 27 and 30. Table 1 also shows that except for the change from the "C11" to the "C12" change keys and the change from the "C18" to the "C19" change key 27, only one master pin 15 need be transferred for a given re-keying. Further, as indicated above with respect to the re-keying from the "C1" change key 30 directly to the "C12" change key 27, such re-keying may be accomplished randomly and not in the sequence in which the change keys are identified in Table 1.

Figure 15:
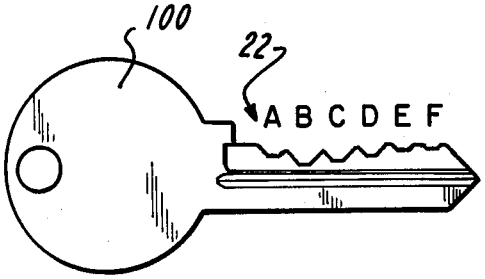
FIG. 15 is a side view of a sub-master key representing one of a series of sub-master keys that may be used with the lock of the second preferred embodiment of the present invention.
Figure 16:
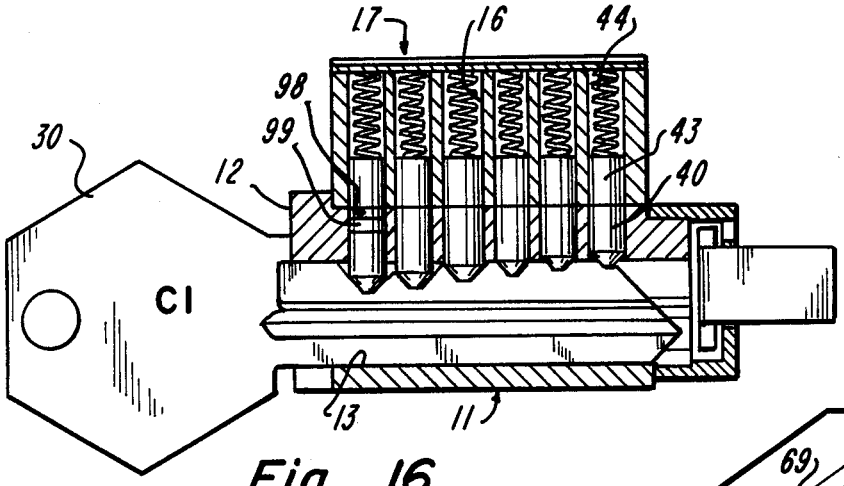
FIG. 16 is a vertical cross-sectional view of the lock of the present invention having tumbler pins and master pins for use of the lock with sub-master keys.

A third preferred embodiment of the lock apparatus 10 of the present invention includes the above described lock 11 shown in FIG. 16 in which the one or two master pins 15 appear in the form of a first master pin 98 having two depths and a second master pin 99 having three depths. This enables the lock 11 to be used with sub-master keys 100 (FIG. 15). Sub-master keys 100 can be used with a selected number of different change keys, such as the change keys 27 and 30. Table 2 identifies a series of 36 change keys, which may be the change keys 27 and 30, that may be randomly selected for use with the lock 11 by the above-described use of the transfer tool 19 and the transfer key 20. Table 2 shows the station positions of the master pins 98 and 99 and the identification of the corresponding change keys 27 and 30 for use with the particular master pin positions. Also shown are the particular bittings for the identified change keys 27 and 30. The sub-master keys 100 usable with the various settings of the lock 11 are represented in FIG. 15 as having bittings of 343210, for example, usable with the C1 through C6 change keys 27 and 30. A similar sub-master key 100 having bittings of 073210 would be used when the lock 11 is keyed for use by the C7 through C12 change keys and similarly one having bittings 046210 for the C13 through C18 change keys, one having bittings 043510 for the C19 through C24 change keys, one having bittings 043240 for the C25 through C30 change keys, and one having bittings 043213 for the C31 through C36 change keys.

Figure 14:
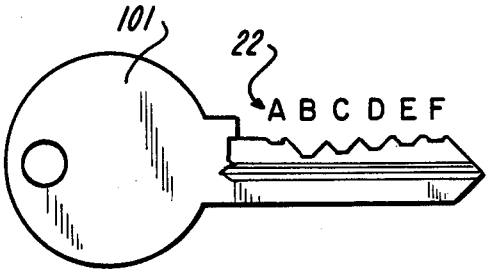
FIG. 14 is a side view of a master key shown having bittings for operating a lock of the second preferred embodiment of the present invention in which the lock may be used with sub-master keys.

The lock 11, provided with the two-depth and three-depth master pins 98 and 99, would be used with a master key 101 shown in FIG. 14 having bittings of 043210.

TABLE 2

| Master Pin Positions | | | | | | Change Key | Change Key Bittings | | | | | |
|---|---|---|---|---|---|---|---|---|---|---|---|---|
| A | B | C | D | E | F | I.D. | A | B | C | D | E | F |
| 2 | | | | | | C1 | 5 | 4 | 3 | 2 | 1 | 0 |
| 3 | | | | | | | | | | | | |
| 3 | 2 | | | | | C2 | 3 | 6 | 3 | 2 | 1 | 0 |
| 3 | | 2 | | | | C3 | 3 | 4 | 5 | 2 | 1 | 0 |
| 3 | | | 2 | | | C4 | 3 | 4 | 3 | 4 | 1 | 0 |
| 3 | | | | 2 | | C5 | 3 | 4 | 3 | 2 | 3 | 0 |
| 3 | | | | | 2 | C6 | 3 | 4 | 3 | 2 | 1 | 2 |
| | 3 | | | | 2 | C7 | 0 | 7 | 3 | 2 | 1 | 2 |
| | 3 | | | 2 | | C8 | 0 | 7 | 3 | 2 | 3 | 0 |
| | 3 | | 2 | | | C9 | 0 | 7 | 3 | 4 | 1 | 0 |
| | 3 | 2 | | | | C10 | 0 | 7 | 5 | 2 | 1 | 0 |
| | 2 | | | | | C11 | 0 | 9 | 3 | 2 | 1 | 0 |
| | 3 | | | | | | | | | | | |
| 2 | 3 | | | | | C12 | 2 | 7 | 3 | 2 | 1 | 0 |
| 2 | | 3 | | | | C13 | 2 | 4 | 6 | 2 | 1 | 0 |
| | 2 | 3 | | | | C14 | 0 | 6 | 6 | 2 | 1 | 0 |
| | | 2 | | | | C15 | 0 | 4 | 8 | 2 | 1 | 0 |
| | | 3 | | | | | | | | | | |
| | | 3 | 2 | | | C16 | 0 | 4 | 6 | 4 | 1 | 0 |
| | | 3 | | 2 | | C17 | 0 | 4 | 6 | 2 | 3 | 0 |

TABLE 2-continued

| Master Pin Positions | | | | | | Change Key | Change Key Bittings | | | | | |
|---|---|---|---|---|---|---|---|---|---|---|---|---|
| A | B | C | D | E | F | I.D. | A | B | C | D | E | F |
| | | 3 | | | 2 | C18 | 0 | 4 | 6 | 2 | 1 | 2 |
| | | | 3 | | 2 | C19 | 0 | 4 | 3 | 5 | 1 | 2 |
| | | | 3 | 2 | | C20 | 0 | 4 | 3 | 5 | 3 | 0 |
| | | | 2 | | | C21 | 0 | 4 | 3 | 7 | 1 | 0 |
| | | | 3 | | | | | | | | | |
| | | 2 | 3 | | | C22 | 0 | 4 | 5 | 5 | 1 | 0 |
| | 2 | | 3 | | | C23 | 0 | 6 | 3 | 5 | 1 | 0 |
| 2 | | | 3 | | | C24 | 2 | 4 | 3 | 5 | 1 | 0 |
| 2 | | | | 3 | | C25 | 2 | 4 | 3 | 2 | 4 | 0 |
| | 2 | | | 3 | | C26 | 0 | 6 | 3 | 2 | 1 | 0 |
| | | 2 | | 3 | | C27 | 0 | 4 | 5 | 2 | 4 | 0 |
| | | | 2 | 3 | | C28 | 0 | 4 | 3 | 4 | 4 | 0 |
| | | | | 2 | | C29 | 0 | 4 | 3 | 2 | 6 | 0 |
| | | | | 3 | | | | | | | | |
| | | | | 3 | 2 | C30 | 0 | 4 | 3 | 2 | 4 | 2 |
| | | | | | 2 | C31 | 0 | 4 | 3 | 2 | 1 | 5 |
| | | | | | 3 | | | | | | | |
| | | | | 2 | 3 | C32 | 0 | 4 | 3 | 2 | 3 | 3 |
| | | | 2 | | 3 | C33 | 0 | 4 | 3 | 4 | 1 | 3 |
| | | 2 | | | 3 | C34 | 0 | 4 | 5 | 2 | 1 | 3 |
| | 2 | | | | 3 | C35 | 0 | 6 | 3 | 2 | 1 | 3 |
| 2 | | | | | 3 | C36 | 2 | 4 | 3 | 2 | 1 | 3 |

As shown in FIG. 16, the lock 11 for use with sub-master keys 100 is provided with tumbler pins 40 having heights of 043210. FIG. 16 shows the first change keys 30 as the "C1" change key identified in Table 2. As shown in Table 2 and in FIG. 16, the master pins 98 and 99 are positioned in the A station pinway 17 below the shear interface 45 by the "C1" first change key 30. To re-key the lock 11 for use by any one of the other 35 randomly selectable change keys 27 shown in Table 2, the "C1" change key 30 is removed from the keyway 13 and the transfer key 20 is inserted therein. For use in the third preferred embodiment, the transfer key 20 is provided with the bittings of the master key 101, which are 043210. The transfer tool 19 is inserted into the keyway 13 and the re-keying operation is performed as described above with respect to the first preferred embodiment. As a result of such re-keying operation, one or both of the master pins 98 or 99 is randomly and selectively repositioned to a different one of the A through F station pinways 17 such that the second change key 27 having the bittings 22 identified in Table 2 is the only change key effective to operate the lock. Once re-keyed, such second change key 27, for example the "C18" change key, would be usable to operate the lock. Also, in the example of the "C18" second change key 27, the sub-master key 100 would be provided with bittings of 046210 for use with the lock 11 when it is keyed for operation by the "C13" through "C18" change keys 27.

While the preferred embodiments have been described in order to illustrate the fundamental relationships of the present invention, it should be understood that numerous variations and modifications may be made to these embodiments without departing from the teachings and concepts of the present invention. Accordingly, it should be clearly understood that the form of the present invention described above and shown in the accompanying drawings is illustrative only and is not intended to limit the scope of the invention to less than that described in the following claims.

What is claimed is:

1. In a lock including a housing; a bore extending through said housing parallel to an axis; a plug having a cylindrical surface and being received in said bore; said bore of said housing and said cylindrical surface of said plug defining a shear interface, said housing and said plug having aligned holes therein forming portions of and combining to form a plurality of pinways that are spaced in the direction of said axis and that are divided by said shear interface; said plug being rotatably received in said bore; a first tumbler stack including a first tumbler pin, a first driver pin and at least one master pin being received in said first pinway; said master pin separating said first driver pin from said first tumbler pin; a second tumbler stack in said second pinway and including a second driver pin and a second tumbler pin; and a keyway formed in said plug and extending from said holes in said plug to said cylindrical surface of said plug; the improvement comprising:

means formed in said surface of said plug adjacent said keyway for guiding a master pin from one of said pinways to another of said pinways, said guiding means having spaced shoulder means for preventing removal of said master pin from said lock.

2. A lock as recited in claim 1, wherein:

said guiding means is a guideway having a width and depth for receiving said master pin; said shoulder means defining a front and a rear shoulder at opposite ends of said guideway, one of said shoulders being aligned with said first pinway at the front of said plug and the other one of said shoulders being aligned with said second pinway at the rear of said plug, said shoulders preventing said master pin from being removed from said lock without disassembly of said lock and permitting said master pin to move randomly in said guideway between said pinways.

3. In a lock apparatus, including a lock as recited in claim 1 and key means and receiving means for use in re-keying said lock, wherein:

said key means has bittings along a first edge thereof for positioning said master pin in said housing portion of said first pinway and aligning the bottom of said master pin with said shear interface; and said receiving means is supported by said key means on the side of said key means opposite to said bittings for receiving said master pin from said housing portion of said first pinway, said receiving means being slidable relative to said key means along said guiding means for moving said master pin in and between said shoulder means of said guiding means to reposition said master pin adjacent to said second pinway without removal of said master pin from or disassembly of said lock, said receiving means being rotatable relative to said key means to transfer said master pin from said guiding means into said second pinway to change the height of said second tumbler stack in said second pinway without removal of said master pin from said lock.

4. A lock apparatus as recited in claim 3, wherein:

said receiving means is a cylindrical rod having a cut formed in one side of said rod for receiving and moving said master pin in said guiding means, said rod has cam means adjacent said cut; and said rotation of said receiving means being effective when said master pin is received in said cut to cause said cam means to move said master pin from both said cut and said guiding means into said second pinway to align said bottom of said master pin with said shear interface.

5. A lock apparatus as recited in claim 4, wherein:

said rod is provided with means for randomly aligning said cut with said pinways to position said cut for successively receiving said master pin from one of said pinways and then moving said master pin into said second pinway.

6. A lock apparatus as recited in claim 3, wherein:

said keyway extends parallel to said axis and from said cylindrical surface radially into said plug for receiving said key means with said bittings nearest the center line of said bore;

said key means in said keyway is adapted to support said receiving means in said keyway adjacent said surface of said plug; and said guiding means formed in said plug is effective to provide space to permit said master pin to move out of said first pinway, into said receiving means, and with said receiving means into alignment with said second pinway, said shoulder means of said guiding means preventing said receiving means from removing said master pin from said lock.

7. A lock apparatus as recited in claim 6, wherein:

said bittings of said key means are master key bittings so that said key means operates said lock no matter how said lock is re-keyed.

8. In a re-keyable lock apparatus, including a lock cylinder housing with a cylindrical bore extending therethrough along a longitudinal axis; a plurality of longitudinally spaced, elongated top pinways in said housing extending perpendicular to and radially outward from said cylindrical bore; a cylindrical plug positioned rotatably in and defining a shear interface with said bore; said plug having a longitudinal keyway therein for receiving a key bit and plurality of longitudinally spaced bottom pinways extending radially inward from the peripheral surface thereof into said keyway; opposite pairs of said bottom pinways and top pinways being adapted to align with each other to form a plurality of common pinways; a top driver pin and a bottom tumbler pin slidably positioned in each of said common pinways; said plug being rotatable when the interface between said top and bottom pins is aligned with said shear interface and not being rotatable when at least one said pin is positioned through said shear interface; the improvement comprising:

master pin means adapted to be directly moved within said lock from one of said common pinways to a randomly selectable other one of said common pinways for providing an additional interface between said top and bottom pins therein to align with said shear interface;

key means adapted for insertion into said keyway and being bitted on one side for rendering said plug rotatable from a first position to a second unlocked position, said key means having a second side opposite said one side and extending along and spaced from said top pin chambers when said plug and said key means have been rotated to said second position;

master pin transfer means adapted to be slidably received in said space between said top pinways and said second side of said key means for receiving said master pin means from said first common pinway and carrying said master pin means within said lock apparatus directly into alignment with said top pinway of said randomly selectable other one of said common pinways; and means connected to said transfer means and extending out of said keyway for indicating that said master pin transfer means is positioned for receiving said master pin means from said first common pinway.

9. A re-keyable lock apparatus as recited in claim 8, wherein;

said transfer means is an elongated member having a cut in one side for receiving said master pin means, said elongated member has a cam surface extending from said cut to the other side of said elongated member; and said indicating means is adapted to rotate said elongated member when said cut is aligned with said top pinway of said randomly selectable other common pinway so that said master pin means rides onto said cam surface and into said top pinway of said other common pinway, said cam surface is adapted to hold said master pin means in said other common pinway until said plug is rotated from said second position toward said first position.

10. A re-keyable lock apparatus as recited in claim 9, wherein:

said key means and said transfer means are reusable for transferring said master pin means from said other common pinway to another randomly selectable common pinway without removing said master pin means from said lock apparatus.

11. A re-keyable lock apparatus as recited in claim 8, wherein:

means are provided for retaining said plug in said bore at a fixed axial position, said means having an opening therein aligned with said keyway when said plug is in said second unlocked position;

said transfer means is an elongated rod having a cut in one side thereof for receiving said master pin means and having a length greater than the axial length of said plug so that a first end thereof is adapted to extend out of said plug when said key means is in said keyway and said transfer means is in said space;

said indicating means includes an index provided on said first end of said transfer means for visual observation outside of said lock apparatus, said indicating means has grooves therein at spaced locations corresponding to the spacing of said common pinways for indicating the axial position of said rod to assist in aligning said cut for receiving said master pin means from and transferring same to selected ones of said common pinways; and said opening in said retaining means is effective to allow an opposite end of said rod to extend rearwardly out of said lock apparatus as said master pin means is carried into alignment with said other common pinway.

12. A re-keyable lock apparatus as recited in claim 8, wherein:

means are provided for retaining said plug in said bore, said means being effective to close one end of said keyway; and said transfer means includes a plurality of elongated rods, each of said rods having a cut in one side thereof for receiving said master pin means, said cuts being located at different axial locations on different ones of said rods so that said transfer means can be slid in said space to align one of said cuts with a selected pair of said common pinways without interference with said retaining means.

13. A re-keying apparatus for randomly relocating a master pin between the top and bottom pins in a plurality of pinways of a tumbler pin lock that has a shear interface that is not penetrated by any of said pins to enable the lock to be operated, the master pin initially being between the top and bottom pins in a first of said pinways and being transferrable to a position between the top and bottom pins in a randomly selected other one of said pinways, comprising:

a key bit adapted for insertion into a keyway of the lock and having bittings along one edge thereof adapted for aligning the interface between the master pin and the bottom pin in the first pinway with the shear interface so that the lock can be operated, said key bit having a second edge opposite said first edge and spaced from the top pins to form a guideway extending adjacent said pinways after said lock is operated;

a master pin carrier adapted to be received in said guideway for rotary and sliding movement relative to said key bit, said master pin carrier having a cut formed in one side thereof for receiving the master pin and cam means adjacent said cut; and handle means connected to said master pin carrier and adapted to extend out of said lock for sliding said carrier in said guideway to align the master pin in said cut with said randomly selected pinway and for rotating said carrier in said guideway to cause said cam means to remove the master pin from said cut and cam the master pin into the randomly selected pinway.

14. A re-keying apparatus as recited in claim 13, wherein:

said master pin carrier and said key bit are provided with detent means that cooperate for releasably retaining said carrier in a position with said cut aligned with a randomly selected one of said pinways so that upon rotation of said carrier a master pin retained in said selected pinway by said cam means transfers into said cut and a master pin in said cut is forced into said selected pinway.

15. A re-keying apparatus as recited in claim 14, wherein:

said lock is provided with at least two pinways that are laterally spaced and intersect said shear interface and with means for biasing said top pins out of said pinways;

said handle means being adapted to move said carrier in said guideway into a first position to render said detent means effective to align said cut with said first pinway, said handle means being adapted to rotatably position said cam means for holding said master pin in said first pinway and to position said cut to receive said master pin from said first pinway under the action of said biasing means; and said handle means being further adapted to slide said carrier along said guideway so that said detent means aligns said master pin in said cut with said randomly selected pinway, said handle means also being adapted to rotate said carrier means so that said master pin rides onto said cam means and is cammed against the action of said biasing means into said randomly selected pinway without first being removed from said lock, said rotation of said handle means being effective to indicate that said master pin has been transferred into said randomly selected pinway.

16. A re-keying apparatus as recited in claim 13, wherein;

said tumbler pin lock is provided with a cylindrical plug having a keyway extending therein from one side thereof, said one side having an elongated channel formed therein adjacent said keyway and extending between the pinways of said lock, said elongated channel being dimensioned to permit said master pin to be received in said cut and transferred between the pinways of the lock and to prevent said carrier from removing said master pin from said lock;

said carrier is an elongated cylindrical rod provided with detent grooves formed therein at spaced locations corresponding to the spacing of the pinways in the lock;

said handle means is connected to said rod and is adapted to extend out of said lock, said handle means being formed to indicate whether said rod is in a first rotary position with said cut disposed to receive said master pin from one of said pinways and whether said rod is in a second rotary position with said cam surface adjacent said pinways; and said key bit has a detent projection mounted for cooperation with said detent grooves to releasably align said cut with randomly selected ones of said pinways while permitting said handle means to rotate said rod to position said cut in alignment with a selected one of said pinways to receive said master pin from said selected pinway and to rotate said rod to render said cam surface effective to cam said master pin into said randomly selected pinway.

17. A re-keying apparatus as recited in claim 13, wherein:

said bittings of said key bit are dimensioned to locate said master pin in said first pinway so that said shear interface is between said master pin and said bottom pin;

said handle means is adapted to slide said carrier to align said cut with said first pinway for receiving said master pin from said first pinway and to slide said carrier having said master pin in said cut toward said randomly selected pinway;

said handle means is adapted to rotate said carrier so that said master pin in said cut rides onto said cam means and into said randomly selected pinway;

said cam means is adapted to hold said master pin in said randomly selected pinway with the interface between the bottom thereof and the top of said bottom pin aligned so that the lock can be operated by rotation to its original position and said key bit removed from the lock; and said master pin in said randomly selected pinway requiring use of a new change key bit to enable operation of said lock, said new change key bit having a bitting corresponding to a first pinway that is shallower than that of said first change key bitting for said first pinway.

18. A re-keying apparatus as recited in claim 13, wherein:

said key bit and carrier are provided with cooperative means external of said lock when said key bit and carrier are inserted into said lock for indicating that said cut is aligned with a selected one of said pinways.

19. In a re-keying apparatus for re-keying a lock without disassembly or removal of parts from or adding parts to the lock, said lock including a housing having a bore formed therein along a given axis and a plurality of upper pinways therein intersecting said bore, a plug rotatably mounted in said bore for defining a shear interface between said plug and said bore along the intersection of said pinways with said bore, said plug having a plurality of lower pinways extending therein from a first side thereof, said opposed ones of said upper and lower pinways forming respective common pinways each having therein a tumbler pin and a driver pin, said plug having a keyway extending therein from a second side thereof for randomly receiving a series of change keys for operating the lock, each change key having a different bitting arrangement according to which of said pinways contains a master pin, said keyway being enlarged adjacent said second side of said plug to form a passageway having a width exceeding the diameter of said master pin and a length extending between opposite ones of said upper pinways; said apparatus comprising:

a transfer key insertable into said keyway, said transfer key having master key bittings selected to locate the intersection of said driver pin and tumbler pin that are in one of said pinways in alignment with said shear interface and to locate the intersection of said master pin and tumbler pin that are in another one of said pinways in alignment with said shear interface and with said master pin in said upper pinway; and a transfer tool slidable in said keyway along said shear interface, said tool having a recess for receiving said master pin from said upper pinway and a cam adjacent said recess, said tool being slidable relative to said transfer key from a first position at which said recess is aligned with said upper pinway and said master pin so that said recess receives said master pin from said upper pinway, said master pin being carried by said tool through said passageway to a second position opposite to a randomly selected one of said upper pinways, said transfer tool being rotatable relative to said transfer key to cause said cam to remove said master pin from said recess and move said master pin into said selected upper pinway so that a different one of said change keys is required to operate said lock.

20. A re-keying apparatus as recited in claim 19, wherein said apparatus further includes:

a first change key having a first bitting at a first station selected to locate the intersection of said driver pin and said master pin in said other one of said common pinways in alignment with said shear interface; and a second change key having a second bitting at said first station that is shallower than said first bitting so that the intersection of said driver pin and tumbler pin in said first common pinway is in alignment with said shear interface after transfer of said master pin to said randomly selected common pinway.

21. A re-keying apparatus as recited in claim 20 for use with said lock having six common pinways provided at stations designated A through F and two master pins provided in selected ones of said common pinways according to the following arrangement; wherein:

said change keys are selected randomly from the following change keys, wherein said change keys have bittings related as follows to said master pin arrangement, where the depth N of said master pins is greater than 1:

| Master Pin Arrangement | | | | | | Change Key Bittings | | | | | | |
|---|---|---|---|---|---|---|---|---|---|---|---|---|
| A | B | C | D | E | F | I.D. | A | B | C | D | E | F |
| N | | | | | | C1 | 5 + 2N | 4 | 3 | 2 | 1 | 0 |
| N | | | | | | | | | | | | |
| N | N | | | | | C2 | 5 + N | 4 + N | 3 | 2 | 1 | 0 |
| N | | N | | | | C3 | 5 + N | 4 | 3 + N | 2 | 1 | 0 |
| N | | | N | | | C4 | 5 + N | 4 | 3 | 2 + N | 1 | 0 |
| N | | | | N | | C5 | 5 + N | 4 | 3 | 2 | 1 + N | 0 |
| N | | | | | N | C6 | 5 + N | 4 | 3 | 2 | 1 | N |
| | N | | | | N | C7 | 5 | 4 + N | 3 | 2 | 1 | N |
| | N | | | N | | C8 | 5 | 4 + N | 3 | 2 | 1 + N | 0 |
| | N | | N | | | C9 | 5 | 4 + N | 3 | 2 + N | 1 | 0 |
| | N | N | | | | C10 | 5 | 4 + N | 3 + N | 2 | 1 | 0 |
| | N | | | | | C11 | 5 | 4 + 2N | 3 | 2 | 1 | 0 |
| | N | | | | | | | | | | | |
| | | N | | | | C12 | 5 | 4 | 3 + 2N | 2 | 1 | 0 |
| | | N | | | | | | | | | | |
| | | N | N | | | C13 | 5 | 4 | 3 + N | 2 + N | 1 | 0 |
| | | N | | N | | C14 | 5 | 4 | 3 + N | 2 | 1 + N | 0 |
| | | N | | | N | C15 | 5 | 4 | 3 + N | 2 | 1 | N |
| | | | N | | N | C16 | 5 | 4 | 3 | 2 + N | 1 | N |
| | | | N | N | | C17 | 5 | 4 | 3 | 2 + N | 1 + N | 0 |
| | | | N | | | C18 | 5 | 4 | 3 | 2 + 2N | 1 | 0 |
| | | | N | | | | | | | | | |
| | | | | N | | C19 | 5 | 4 | 3 | 2 | 1 + 2N | 0 |
| | | | | N | | | | | | | | |
| | | | | N | N | C20 | 5 | 4 | 3 | 2 | 1 + N | N |
| | | | | | N | C21 | 5 | 4 | 3 | 2 | 1 | 2N |
| | | | | | N | | | | | | | |

22. A re-keying apparatus as recited in claim 20 for use with said lock having six common pinways provided at stations designated A through F and one two-depth and one three-depth master pin provided in selected ones of said common pinways according to the following arrangement; wherein:

said change keys are selected randomly from the following change keys, said change keys have bittings related as follows to said arrangement of masters:

| Master Pin Positions | | | | | | Change Key | Change Key Bittings | | | | | |
|---|---|---|---|---|---|---|---|---|---|---|---|---|
| A | B | C | D | E | F | I.D. | A | B | C | D | E | F |
| 2 | | | | | | C1 | 5 | 4 | 3 | 2 | 1 | 0 |
| 3 | | | | | | | | | | | | |
| 3 | 2 | | | | | C2 | 3 | 6 | 3 | 2 | 1 | 0 |
| 3 | | 2 | | | | C3 | 3 | 4 | 5 | 2 | 1 | 0 |
| 3 | | | 2 | | | C4 | 3 | 4 | 3 | 4 | 1 | 0 |
| 3 | | | | 2 | | C5 | 3 | 4 | 3 | 2 | 3 | 0 |
| 3 | | | | | 2 | C6 | 3 | 4 | 3 | 2 | 1 | 2 |
| | 3 | | | | 2 | C7 | 0 | 7 | 3 | 2 | 1 | 2 |
| | 3 | | | 2 | | C8 | 0 | 7 | 3 | 2 | 3 | 0 |
| | 3 | | 2 | | | C9 | 0 | 7 | 3 | 4 | 1 | 0 |
| | 3 | 2 | | | | C10 | 0 | 7 | 5 | 2 | 1 | 0 |
| | 2 | | | | | C11 | 0 | 9 | 3 | 2 | 1 | 0 |
| | 3 | | | | | | | | | | | |
| 2 | 3 | | | | | C12 | 2 | 7 | 3 | 2 | 1 | 0 |
| 2 | | 3 | | | | C13 | 2 | 4 | 6 | 2 | 1 | 0 |
| | 2 | 3 | | | | C14 | 0 | 6 | 6 | 2 | 1 | 0 |
| | | 2 | | | | C15 | 0 | 4 | 8 | 2 | 1 | 0 |
| | | 3 | | | | | | | | | | |
| | | 3 | 2 | | | C16 | 0 | 4 | 6 | 4 | 1 | 0 |
| | | 3 | | 2 | | C17 | 0 | 4 | 6 | 2 | 3 | 0 |
| | | 3 | | | 2 | C18 | 0 | 4 | 6 | 2 | 1 | 2 |
| | | | 3 | | 2 | C19 | 0 | 4 | 3 | 5 | 1 | 2 |
| | | | 3 | 2 | | C20 | 0 | 4 | 3 | 5 | 3 | 0 |
| | | | 2 | | | C21 | 0 | 4 | 3 | 7 | 1 | 0 |
| | | | 3 | | | | | | | | | |
| | | 2 | 3 | | | C22 | 0 | 4 | 5 | 5 | 1 | 0 |
| | 2 | | 3 | | | C23 | 0 | 6 | 3 | 5 | 1 | 0 |
| 2 | | | 3 | | | C24 | 2 | 4 | 3 | 5 | 1 | 0 |
| 2 | | | | 3 | | C25 | 2 | 4 | 3 | 2 | 4 | 0 |
| | 2 | | | 3 | | C26 | 0 | 6 | 3 | 2 | 1 | 0 |
| | | 2 | | 3 | | C27 | 0 | 4 | 5 | 2 | 4 | 0 |
| | | | 2 | 3 | | C28 | 0 | 4 | 3 | 4 | 4 | 0 |
| | | | | 2 | | C29 | 0 | 4 | 3 | 2 | 6 | 0 |
| | | | | 3 | | | | | | | | |
| | | | | 3 | 2 | C30 | 0 | 4 | 3 | 2 | 4 | 2 |
| | | | | | 2 | C31 | 0 | 4 | 3 | 2 | 1 | 5 |
| | | | | | 3 | | | | | | | |
| | | | | 2 | 3 | C32 | 0 | 4 | 3 | 2 | 3 | 3 |
| | | | 2 | | 3 | C33 | 0 | 4 | 3 | 4 | 1 | 3 |
| | | 2 | | | 3 | C34 | 0 | 4 | 5 | 2 | 1 | 3 |
| | 2 | | | | 3 | C35 | 0 | 6 | 3 | 2 | 1 | 3 |
| 2 | | | | | 3 | C36 | 2 | 4 | 3 | 2 | 1 | 3 |

23. A method of rendering a lock re-keyable for use with a plurality of different change keys, said re-keying being without disassembling said lock or removing any parts from or adding any parts to said lock each time said lock is re-keyed for use with a different change key, wherein said lock is initially designed such that the re-keying thereof can be performed only upon diassembly of said lock; said lock including a housing; a bore extending axially through said housing to define a shear interface; a plug received in said bore and having a keyway that extends therein from a first surface thereof; said housing and said plug having aligned holes therein forming at least first and second pinways that are located at opposite axial ends of said plug and that are divided by said shear interface; said plug being rotatably received in said bore; a first pin stack including a first tumbler pin and a first driver pin received in said first pinway, and a second pin stack in said second pinway and including a second driver pin and a second tumbler pin, said method of rendering comprising the steps of:

removing said plug from said bore;

inserting at least one master pin in said first pinway between said first tumbler pin and said first driver pin;

enlarging said keyway along the intersection thereof with said first surface of said plug and only for a distance corresponding to the distance from said first pinway to said second pinway, the depth of said enlarged keyway being sufficient to receive said master pin and the width of said enlarged keyway being sufficient to permit said master pin to slide between said first and second pinways; and replacing said plug in said bore.

24. A method of re-keying a lock that has been rendered re-keyable for use with different change keys as recited in claim 23, which comprises the further steps of:

providing a transfer key having bittings along one edge for unlocking said lock;

providing a master pin transfer tool having a cut therein and a cam opposite to said cut;

inserting said transfer key and said tool into said keyway;

unlocking said lock by rotating said plug, said reset key and said tool to position said tool along said shear interface with said first tumbler pins supported by said cam;

moving said tool relative to said key to position said cut for receiving said master pin from said first pinway;

moving said tool relative to said key to slide said master pin within said enlarged keyway into alignment with said second pinway; and moving said tool relative to said key to transfer said master pin from said cut into said first pinway so that the height of said pin stack in said first and second pinways is changed by the height of said master pin so that said second change key must have a shallower bitting depth corresponding to said second pinway and may have a deeper bitting depth corresponding to said first pinway.

25. A method of re-keying a lock for use with a plurality of different change keys and a single master key without disassembling the lock or removing any parts therefrom, said lock including a housing; a bore extending through said housing to define a shear interface; a plug received in said bore and having a keyway that extends therein from a first surface thereof, said housing and said plug having aligned holes therein forming at least first and second pinways that are spaced in the direction in which said bore extends through said housing and that are divided by said shear interface; said keyway being enlarged along the intersection thereof with said first surface of said plug and only for a distance corresponding to the distance from said first pinway to said second pinway, the depth and width of said enlarged keyway being sufficient to receive said master pin and to permit said master pin to slide to and between said first and second pinways; said plug being rotatably received in said bore; a first pin stack including a first tumbler pin, at least one master pin and a first driver pin received in said first pinway, and a second pin stack in said second pinway and including a second driver pin and a second tumbler pin; said method comprising the steps of:

inserting into said keyway a key having bittings along one edge for unlocking said lock;

inserting into said keyway a master pin transfer tool slidable along an opposite edge of said key, said tool having a cut therein and a cam opposite to said cut;

unlocking said lock by rotating said plug and said reset key to position said tool along said shear interface;

moving said tool relative to said key to position said cut for receiving said master pin from said first pinway;

moving said tool relative to said key to slide said master pin within said enlarged keyway into alignment with said second pinway; and moving said tool relative to said key to transfer said master pin from said cut into said first pinway so that the height of said pin stack in said first and second pinways is changed by the height of said master pin so that said second change key must have a shallower bitting depth corresponding to said first pinway and may have a deeper bitting depth corresponding to said second pinway.

26. A method of re-keying a lock as recited in claim 25, wherein the setting of the lock may be reversed without disassembling the lock, comprising the further steps of:

unlocking said lock by again inserting said key into said keyway and rotating said plug and said key to position said tool along said shear interface;

performing said moving steps again with said cut initially positioned to receive said master pin from said second pinway and to transfer said master pin to and insert said master pin into said first pinway; and performing said rotating step again to restore the stack heights to their original amounts without disassembling said lock.

27. In a re-keyable lock apparatus, including a lock cylinder housing with a cylindrical bore extending therethrough along a longitudinal axis; a plurality of longitudinally spaced, elongated top pinways in said housing extending perpendicular to and radially outward from said cylindrical bore; a cylindrical plug positioned rotatably in and defining a shear interface with said bore; said plug having a longitudinal keyway therein for receiving a key bit, said plug also having a plurality of longitudinally spaced bottom pinways extending radially inward from the peripheral surface thereof into said keyway; opposite pairs of said bottom pinways and said top pinways being adapted to align with each other to form a plurality of common pinways; a top driver pin and a bottom tumbler pin slidably positioned in each of said common pinways; said plug being rotatable when the interface between said top and bottom pins is aligned with said shear interface and not being rotatable when at least one said pin is positioned through said shear interface; the improvement comprising:

master pin means adapted to be directly moved within said lock from one of said common pinways to a randomly selectable other one of said common pinways for providing an additional interface between said top and bottom pins therein to align with said shear interface;

key means adapted for insertion into said keyway and being bitted on one side for rendering said plug rotatable from a first position to a second unlocked position, said key means having a second side opposite said one side and extending along and spaced from said top pin chambers when said plug and said key means have been rotated to said second position; and master pin transfer means adapted to be slidably received in said space between said top pinways and said second side of said key means for receiving said master pin means from said first common pinway, carrying said master pin means within said lock apparatus directly into alignment with said top pinway of said randomly selectable other one of said common pinways and moving said master pin means into said top pinway of said randomly selectable other one of said common pinways.

* * * * *